US008347863B2

(12) United States Patent
Cwielong et al.

(10) Patent No.: US 8,347,863 B2
(45) Date of Patent: Jan. 8, 2013

(54) METHOD FOR CONTROLLING A FUEL DELIVERY DEVICE ON AN INTERNAL COMBUSTION ENGINE

(75) Inventors: Martin Cwielong, Regensburg (DE); Gerhard Eser, Hemau (DE); Gerhard Schopp, Pettendorf (DE)

(73) Assignee: Continental Automotive GmbH, Hannover (DE)

( * ) Notice: Subject to any disclaimer, the term of this patent is extended or adjusted under 35 U.S.C. 154(b) by 0 days.

(21) Appl. No.: 11/913,125

(22) PCT Filed: Apr. 13, 2006

(86) PCT No.: PCT/EP2006/061588

§ 371 (c)(1),
(2), (4) Date: Oct. 30, 2007

(87) PCT Pub. No.: WO2006/117287

PCT Pub. Date: Nov. 9, 2006

(65) Prior Publication Data

US 2008/0210200 A1 Sep. 4, 2008

(30) Foreign Application Priority Data

May 3, 2005 (DE) ..... 10 2005 020 686

(51) Int. Cl.
*F02M 37/00* (2006.01)

(52) U.S. Cl. ..... 123/511; 123/510

(58) Field of Classification Search ..... 123/435, 123/456, 478, 480, 497, 510, 511, 357, 446, 123/447

See application file for complete search history.

(56) References Cited

U.S. PATENT DOCUMENTS

| | | | | |
|---|---|---|---|---|
| 6,234,144 | B1 * | 5/2001 | Yamaguchi et al. | 123/399 |
| 6,450,147 | B2 * | 9/2002 | Demura et al. | 123/458 |
| 6,712,045 | B1 * | 3/2004 | McCarthy, Jr. | 123/456 |
| 6,840,220 | B2 * | 1/2005 | Yomogida et al. | 123/456 |
| 6,971,368 | B2 * | 12/2005 | Uchiyama | 123/359 |
| 7,171,944 | B1 * | 2/2007 | Oono | 123/357 |

(Continued)

FOREIGN PATENT DOCUMENTS

DE 4120000 12/1992

(Continued)

OTHER PUBLICATIONS

International Search Report; PCT/EP2006/061588; pp. 12, Apr. 13, 2006.

(Continued)

*Primary Examiner* — Stephen K Cronin
*Assistant Examiner* — Sizo Vilakazi
(74) *Attorney, Agent, or Firm* — King & Spalding L.L.P.

(57) ABSTRACT

An internal combustion engine has a fuel delivering device with a high-pressure pump which conveys fuel into a fuel reservoir, and a volume flow control valve that is assigned to the high-pressure pump. A control difference (FUP_DIF) is determined from a difference between a predefined fuel pressure (FUP_SP) and a detected fuel pressure (FUP_AV). The control difference (FUP_DIF) is fed to a controller that encompasses at least one integral portion (I_CTRL). A corrective value (COR) for an error value of a fuel flow rate is determined in accordance with the integral portion (I_CTRL) of the controller if a sum of the integral portion (I_CTRL) exceeds a given threshold value during a predefined mode of operation of the internal combustion engine. In addition, an actuating signal (PWM) for the volume flow control valve is generated according to a controller value (FUEL_MASS_F-B_CTRL) and the corrective value (COR).

12 Claims, 4 Drawing Sheets

U.S. PATENT DOCUMENTS

| | | | | |
|---|---|---|---|---|
| 7,270,113 | B2 * | 9/2007 | Hervault et al. | 123/446 |
| 7,293,548 | B2 * | 11/2007 | Oono | 123/446 |
| 7,328,689 | B2 * | 2/2008 | Achleitner et al. | 123/446 |
| 7,422,002 | B2 * | 9/2008 | Mueller | 123/458 |
| 2001/0027774 | A1 * | 10/2001 | Saiki | 123/339.19 |
| 2003/0019478 | A1 * | 1/2003 | Gibson et al. | 123/456 |
| 2005/0005880 | A1 * | 1/2005 | Bale et al. | 123/90.11 |
| 2006/0081219 | A1 * | 4/2006 | Nomura et al. | 123/458 |

FOREIGN PATENT DOCUMENTS

| | | |
|---|---|---|
| DE | 19731994 | 1/1999 |
| DE | 19752025 | 7/1999 |
| DE | 10162989 | 10/2003 |
| DE | 10336499 | 4/2004 |
| DE | 102004016943 | 11/2005 |
| DE | 102004049812 | 4/2006 |
| EP | 1439292 | 7/2004 |
| EP | 1441119 | 7/2004 |
| GB | 2331597 | 5/1999 |

OTHER PUBLICATIONS

Office Action for German Application No. 10 2005 020 686.7-26 (5 pages), Dec. 1, 2005.

Search Report for International Patent Application No. PCT/EP2006/061588 (3 pages), Jul. 14, 2006.

* cited by examiner

METHOD FOR CONTROLLING A FUEL DELIVERY DEVICE ON AN INTERNAL COMBUSTION ENGINE

CROSS-REFERENCE TO RELATED APPLICATIONS

This application is a U.S. national stage application of International Application No. PCT/EP2006/061588 filed Apr. 13, 2006, which designates the United States of America, and claims priority to German application number 10 2005 020 686.7 filed May 3, 2005, the contents of which are hereby incorporated by reference in their entirety.

TECHNICAL FIELD

The invention relates to a method for controlling a fuel delivering device of an internal combustion engine. The fuel delivering device comprises a high-pressure pump and a volume flow control valve that is assigned to the high-pressure pump.

BACKGROUND

High demands are made on internal combustion engines, in particular in motor vehicles. Pollutant emissions are subject to legal regulations and the customer requests a low fuel consumption, a safe and reliable operation and low maintenance costs. In order to fulfill the requirements, a reliable operation of the fuel delivering device is necessary.

SUMMARY

A method and an appropriate device for controlling a fuel delivering device of an internal combustion engine in a reliable manner can be achieved by a method for controlling a fuel delivering device of an internal combustion engine, wherein the fuel delivering device has a high-pressure pump, which conveys fuel into a fuel reservoir, a volume flow control valve that is assigned to the high-pressure pump, wherein the method comprises the steps of determining a control difference from a difference between a predefined fuel pressure and a detected fuel pressure, feeding the control difference to a controller that encompasses at least one integral portion, determining a corrective value for an error value of a fuel flow rate in accordance with the integral portion of the controller if a absolute value of the integral portion exceeds a predetermined threshold value during a predefined mode of operation of the internal combustion engine, and generating an actuating signal for the volume flow control valve according to a controller value of the controller and the corrective value.

According to an embodiment, the corrective value can be determined as the integral portion of the controller multiplied by a predetermined factor. According to an embodiment, the predetermined factor may comprise a predetermined step width factor or in which the corrective value is determined as the integral portion of the controller multiplied by the predetermined factor and multiplied by the predetermined step width factor. According to an embodiment, the predefined mode of operation can be a stationary mode of operation. According to an embodiment, in the predefined mode of operation, a desired value of a fuel flow rate through the volume flow control valve can be less than a predetermined flow rate threshold value.

According to another embodiment, a device can be designed for controlling a fuel delivering device of an internal combustion engine, with the fuel delivering device comprising a high-pressure pump, which conveys fuel into a fuel reservoir, a volume flow control valve, that is assigned to the high-pressure pump, wherein the device is operable to determine a control difference from a difference between a predefined fuel pressure and a detected fuel pressure, to feed the control difference to a controller that encompasses at least one integral portion, to determine a corrective value for an error value of a fuel flow rate in accordance with the integral portion of the controller if a absolute value of the integral portion exceeds a predetermined threshold value during a predefined mode of operation of the internal combustion engine, and to generate an actuating signal for the volume flow control valve according to a controller value of the controller and the corrective value.

BRIEF DESCRIPTION OF THE DRAWINGS

The invention is described in more detail below with reference to exemplary embodiments and the associated drawings. They are as follows.

In the figures in the drawings, the same reference characters refer to the same or functionally comparable components.

DETAILED DESCRIPTION

Figure 1:
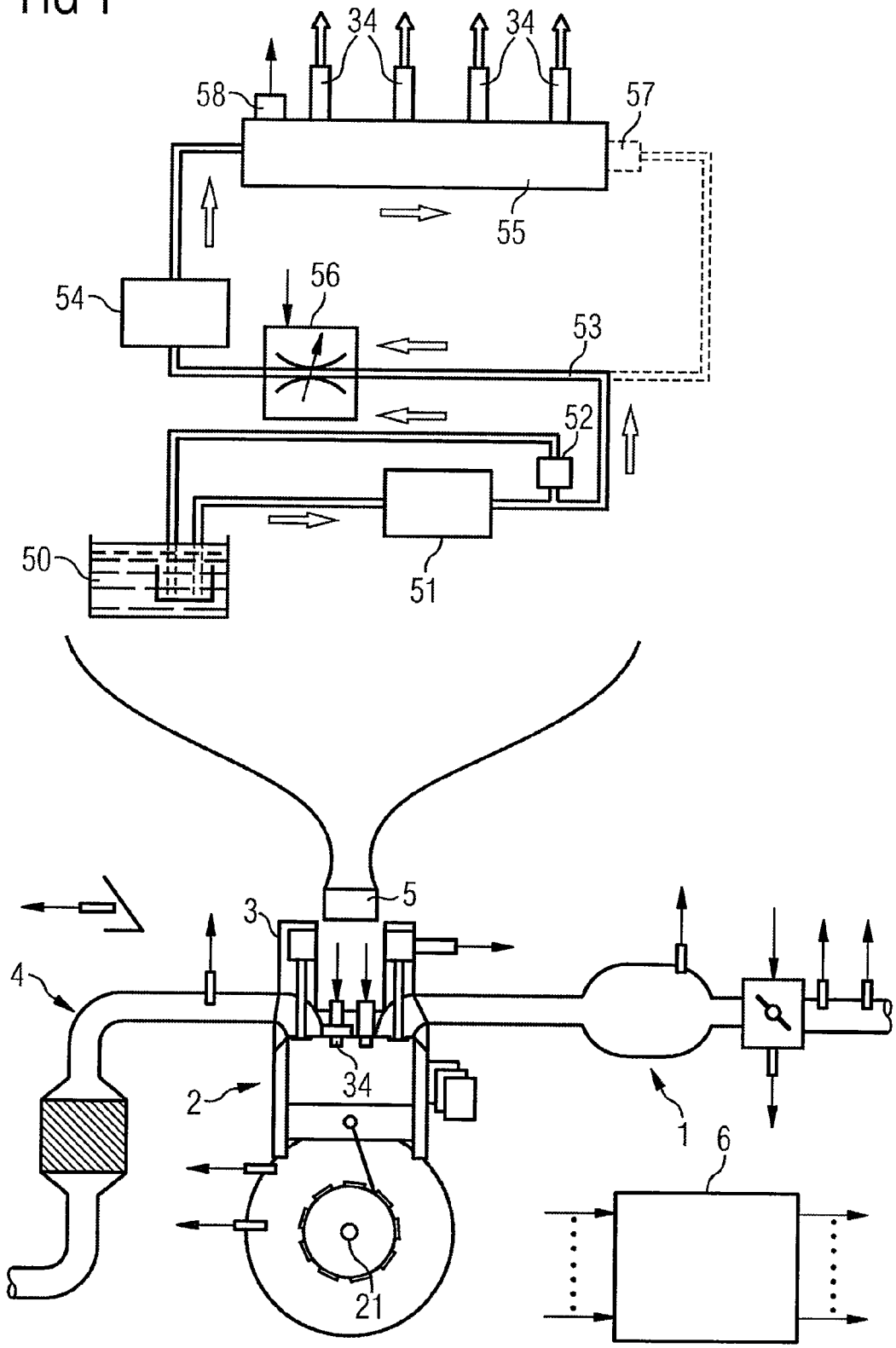
FIG. 1 an internal combustion engine with a fuel delivering device and a device for controlling the fuel delivering device, FIG. 2 a characteristic curve diagram of a volume flow control valve, FIG. 3 an enlarged detail of the characteristic curve diagram, FIG. 4 a block diagram of a regulating device for controlling the fuel pressure and FIG. 5 a flowchart for determining a corrective value.

According to various embodiments, in a method and an appropriate device for controlling a fuel delivering device of an internal combustion engine, the fuel delivering device comprises a high-pressure pump, which conveys fuel into a fuel reservoir, and a volume flow control valve that is assigned to the high-pressure pump. A control difference is determined from a difference between a predefined fuel pressure and a detected fuel pressure. The control difference is fed to a controller that encompasses at least one integral portion. A corrective value for an error value of a fuel flow rate is determined in accordance with the integral portion of the controller, if a absolute value of the integral portion exceeds a predetermined threshold value during a predefined mode of operation of the internal combustion engine. In addition, an actuating signal for the volume flow control valve is generated in accordance with a controller value of the controller and the corrective value.

According to various embodiments, in the predefined mode of operation the integral portion is representative of the error value of the fuel flow rate. A difference between an actual value of the fuel flow rate and a desired value of the fuel flow rate, which is predetermined for example by a predefined characteristic curve of the volume flow control valve, causes a deviation of the absolute value of the integral portion of the controller from zero in the predefined mode of operation. Taking into account the error value, makes a precise and reliable controlling of an internal combustion engine possible. In addition, the use of the integral portion for determining the error value or the corrective value is very simple. In this way, component tolerances can become balanced, which can lead to different large error values of the fuel flow rate in the case of different volume flow control valves.

In an advantageous development, the corrective value is determined as the integral portion of the controller multiplied by a predetermined factor. This has the advantage that it is very simple to determine the corrective value in this way.

In this connection it is advantageous for the predetermined factor to comprise a predetermined step width factor or the corrective value is determined as the integral portion of the controller multiplied by the predetermined factor and multiplied by the predetermined step width factor. The advantage is that the correcting of the error value of the fuel flow rate in this way can take place iteratively in a plurality of iteration steps. In this way, the actuating signal of the volume flow control valve is adjusted slowly and an erratic change in the actuating signal and the fuel pressure is prevented. Thus it is possible to control the fuel pressure in a particularly reliable manner.

In a further advantageous development, the predefined mode of operation is a stationary mode of operation. In the stationary mode of operation of the internal combustion engine, operating variables of the internal combustion engine, for example an injected quantity of fuel, a fuel pressure or a temperature of the internal combustion engine, are essentially stationary. The advantage is that in the stationary mode of operation, dynamic changes in the operating variables do not have to be taken into account and that it is simple to control the fuel delivering device in this way.

In a further advantageous development, in the predefined mode of operation, a desired value of the fuel flow rate through the volume flow control valve is less than a predetermined flow rate threshold value. The flow rate threshold value can be selected in such a way that said value is about as large as that of a leakage flow rate of the volume flow control valve. The leakage flow rate of the volume flow control valve can then in particular be determined precisely in the form of an error value of the fuel flow rate.

An internal combustion engine (FIG. 1) comprises an intake tract 1, an engine block 2, a cylinder head 3, and an exhaust gas tract 4. The engine block 2 comprises a number of cylinders, which have pistons and connecting rods by means of which they are connected to a crankshaft 21.

The cylinder head 3 comprises a valve train with a gas intake valve and a gas discharge valve and valve gears. The cylinder head 3 also comprises both an injection valve 34 and a spark plug.

In addition, provision is made for a fuel delivering device 5. The fuel delivering device 5 comprises a fuel tank 50, which is connected to a low-pressure pump 51 via a first fuel line. On the outlet side, said low-pressure pump 51 has an operative connection to an intake 53 of a high-pressure pump 54. In addition, on the outlet side of the low-pressure pump 51, provision is also made for a mechanical regulator 52, which on the outlet side is connected to the fuel tank 50 via an additional fuel line. The low-pressure pump 51, the mechanical regulator 52, the fuel line, the additional fuel line and the intake 53 form a low-pressure circuit.

The low-pressure pump 51 can be preferably embodied in such a way that while the internal combustion engine is operating, it always supplies a sufficient amount of fuel, which guarantees that a predetermined low-pressure value does not drop below the required minimum. The intake 53 leads up to the high-pressure pump 54, which on the outlet side conveys fuel into a fuel reservoir 55. The high-pressure pump 54 is usually driven by the camshaft and, in this way, conveys a constant volume of fuel at a constant speed of the crankshaft 21. The injection valves 34 have an operative connection to the fuel reservoir 55. The fuel is fed to the injection valves 34 via a fuel reservoir 55 in this way.

In the feed line of the high-pressure pump 54, this means upstream of the high-pressure pump 54, provision is made for a volume flow control valve 56 by means of which a volume flow, which is fed to the high-pressure pump 54 can be set. By controlling the volume flow control valve 56 in a corresponding manner, a predetermined fuel pressure FUP_SP can be set in the fuel reservoir 55.

In addition, the fuel delivering device 5 can also be provided with an electromagnetic pressure regulator 57 on the outlet side of the fuel reservoir 55 and with a return line in the low-pressure circuit. In accordance with an actuating signal of the electromechanical pressure regulator 57, the electromechanical pressure regulator 57 is closed, if a fuel pressure in the fuel reservoir 55 drops below a fuel pressure FUP_SP predetermined by the actuating signal, and opens, if the fuel pressure in the fuel reservoir 55 exceeds the predetermined fuel pressure FUP_SP.

The volume flow control valve 56 can also be integrated into the high-pressure pump 54. Likewise, the electromechanical pressure regulator 57 and the volume flow control valve 56 can be configured in such a way that they are set by means of a common actuator.

In addition, a control device 6 is assigned to the internal combustion engine, which forms a device for controlling the fuel delivering device 5. Sensors are again assigned to the control device 6, said sensors detecting the different measured quantities and in each case determining the measured value of the measured quantity. The control device 6 determines, in accordance with at least one of the measured quantities, the correcting variables, which are then converted into corresponding actuating signals for controlling the final control elements by means of corresponding actuators.

The sensors are for example a pedal position indicator which detects the position of an accelerator pedal, a crankshaft angle sensor which detects a crankshaft angle and to which a rotational speed is then allocated, a mass air flow meter or a fuel pressure sensor 58 which detects the fuel pressure FUP_AV in the fuel reservoir 55. Depending on the embodiment, any subset of the sensors or also additional sensors can be made available in each case.

The final control elements are for example configured as gas intake valves or gas exhaust valves, injection valves 34, a spark plug, a throttle valve, a low-pressure pump 51 or a volume flow control valve 56.

The internal combustion engine also has further cylinders to which corresponding final control elements may then preferably be assigned.

Figure 2:
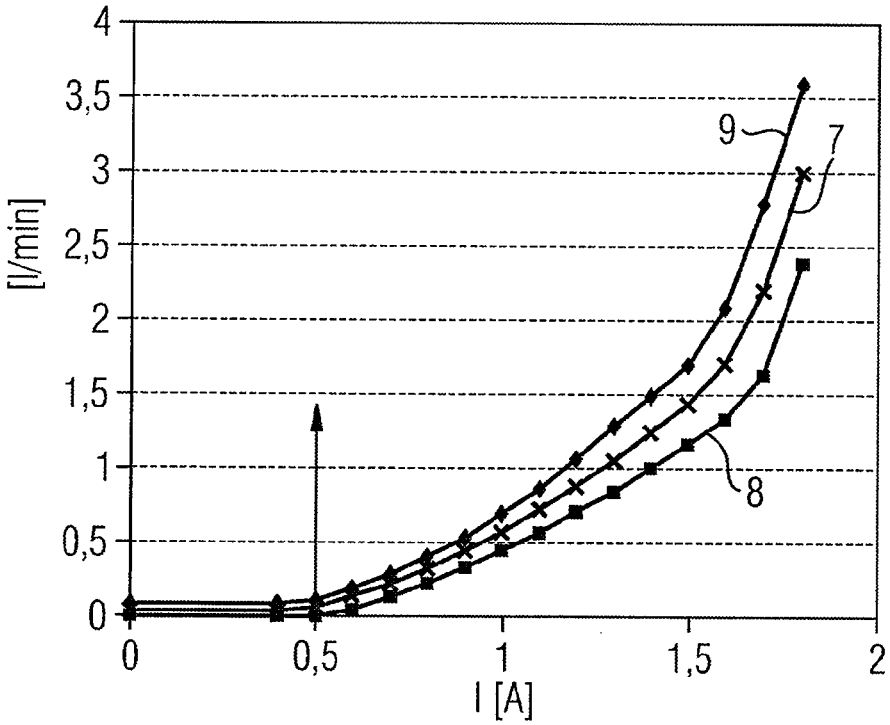
Figure 3:
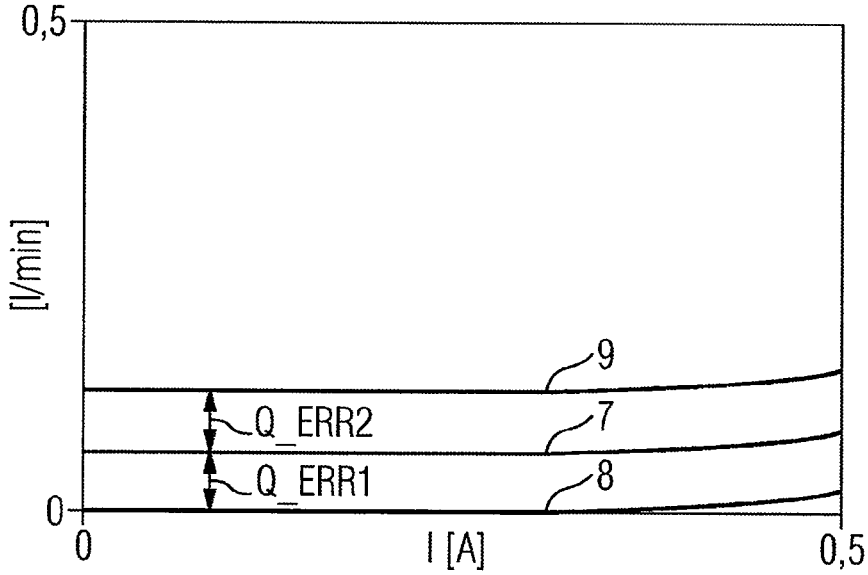

FIG. 2 shows a characteristic curve diagram of the volume flow control valve 56 and FIG. 3 shows an enlarged detail of the characteristic curve diagram. The characteristic curve diagram shows a fuel flow rate through the volume flow control valve 56 in liters per minute against an electric current I of the volume flow control valve 56 in ampere. The electric current I results from an actuating signal PWM of the volume flow control valve 56, which is for example a pulse-width modulated signal. A predefined characteristic curve 7 represents for example an average value of the characteristic curves of different volume flow control valves 56, it for example being possible that the individual characteristic curves thereof can be differentiated from each other on the basis of component tolerances. A first characteristic curve 8 and a second characteristic curve 9 deviate from the predefined characteristic curve 7 and represent different volume flow control valves 56.

For values of the actuating signal PWM, which are greater than a threshold value, to which in this exemplary embodiment a value of the electric current of approximately 0.5 ampere corresponds, opens the volume flow control valve 56 and enables the fuel flow rate through the volume flow control valve 56. For values of the actuating signal PWM, which are less than the threshold value, the volume flow control valve 56 is essentially closed. However, a leakage flow rate can flow through the volume flow control valve 56. On the basis of component tolerances, the leakage flow rate for different volume flow control valves 56 can be different. The specific characteristic curve of the volume flow control valve 56 therefore generally deviates from the predefined characteristic curve 7. Therefore, the fuel flow rate through the volume flow control valve 56 in the closed state exhibits an error value Q_ERR in relation to the fuel flow rate predetermined by the predefined characteristic curve 7. Thus for example the first characteristic curve 8 exhibits a first error value Q_ERR1 and the second characteristic curve 9 a second error value Q_ERR2 in relation to the predefined characteristic curve 7. The first error value Q_ERR1 and the second error value Q_ERR2 correspond to a shift of the first characteristic curve 8 or the second characteristic curve 9 in relation to the predefined characteristic curve 7.

Figure 4:
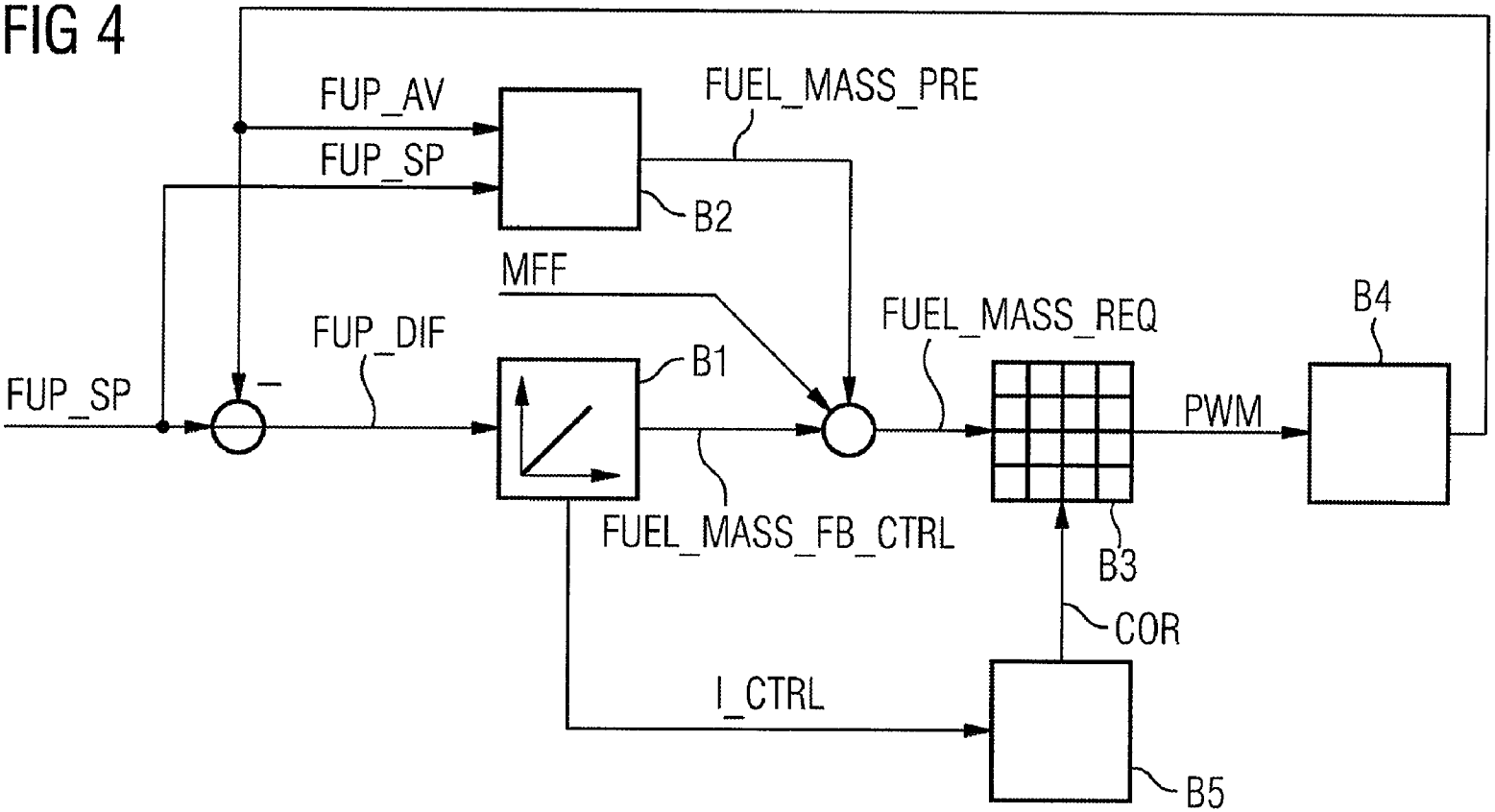

FIG. 4 shows a block diagram of a regulating device for controlling the fuel pressure in the fuel delivering device 5, in particular in the fuel reservoir 55. The regulating device may be preferably configured in the control device 6.

In a first mode of operation, the fuel pressure is set in the fuel reservoir 55 in accordance with the quantity of fuel conveyed by the high-pressure pump 54. The conveyed quantity of fuel is in accordance with the control of the volume flow control valve 56. If more fuel is conveyed into the fuel reservoir 55 than is injected by means of the injection valves 34, then the fuel pressure in the fuel reservoir 55 increases. If less fuel is conveyed into the fuel reservoir 55 than is injected by means of the injection valves 34, then the corresponding fuel pressure in the fuel reservoir 55 decreases.

A control difference FUP_DIF is determined from a difference between a predefined fuel pressure FUP_SP and a detected fuel pressure FUP_AV. The control difference FUP_DIF is fed to a controller in a block B1. This controller encompasses at least one integral portion I_CTRL and may be preferably configured as a PI-controller. In a block B1, a controller value FUEL_MASS_FB_CTRL is determined.

In accordance with the predetermined fuel pressure FUP_SP and the detected fuel pressure FUP_AV, in a block B2 a pre-control value FUEL_MASS_PRE of a quantity of fuel FUEL_MASS_REQ to be conveyed is determined. The pre-control value FUEL_MASS_PRE of the quantity of fuel FUEL_MASS_REQ to be conveyed, the controller value FUEL_MASS_FB_CTRL of the first controller and a quantity of fuel MFF to be injected are added together to form a quantity of fuel FUEL_MASS_REQ to be conveyed.

In a block B3, in accordance with the quantity of fuel FUEL_MASS_REQ to be conveyed, the actuating signal PWM is determined. The block B3 preferably may comprise a characteristic diagram. The characteristic diagram preferably may comprise the predefined characteristic curve 7 of the volume flow control valve 56.

A block B4 represents the fuel delivering device 5. The actuating signal PWM is the input variable of the block B4. The output variable of the block B4 is the detected fuel pressure FUP_AV, which is detected for example by means of the fuel pressure sensor 58.

In a block B5, a corrective value COR is determined in accordance with the integral portion I_CTRL of the controller in the block B1, if a predefined mode of operation BZ, for example a stationary mode of operation is present. The corrective value COR is fed to the block B3 for correcting the error value Q_ERR of the fuel flow rate. For example, the predefined characteristic curve 7, in the block B3, is shifted according to the corrective value COR. As an alternative, the corrective value COR can also be added to the quantity of fuel FUEL_MASS_REQ to be conveyed.

The characteristic diagram in the block B3 may be preferably determined in advance by means of tests on an engine test stand, by simulations or by means of driving tests. As an alternative, functions based on physical models can also for example be used.

In a second mode of operation, the fuel pressure in the fuel reservoir 55 is set by means of the electromechanical pressure regulator 57. The second mode of operation may be preferably assumed if the quantity of fuel MFF to be injected is less than the leakage flow rate of the volume flow control valve 56, for example, when the internal combustion engine is at idle or when the internal combustion engine is in the overrun mode. The first mode of operation may be preferably assumed if the quantity of fuel MFF to be injected is greater than the leakage flow rate of the volume flow control valve 56. By correcting the predefined characteristic curve 7 or the leakage flow rate, a reliable conversion from the first mode of operation of the internal combustion engine to the second mode of operation of the internal combustion engine is possible.

Figure 5:
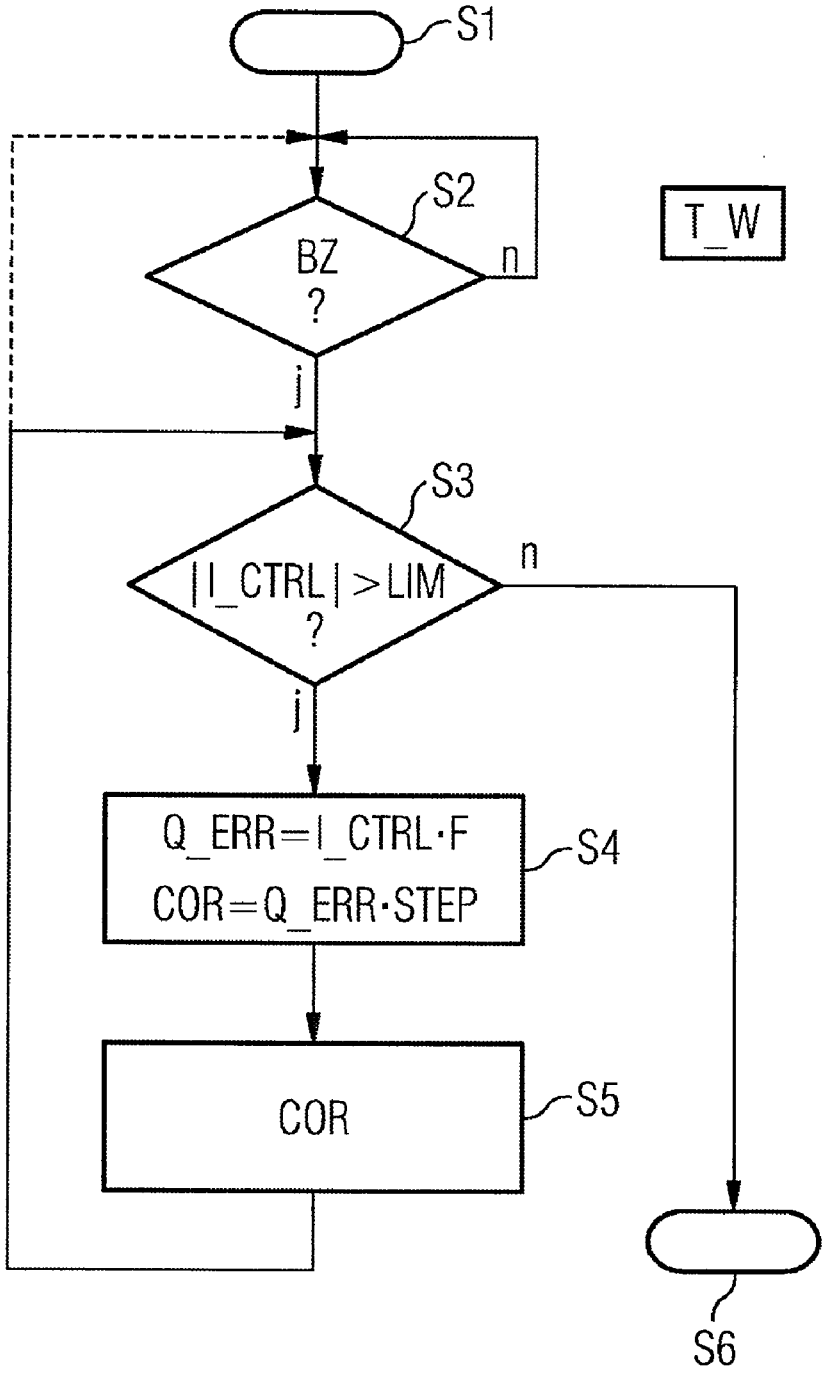

FIG. 5 shows a flowchart of a program for determining the error value Q_ERR of the fuel flow rate and the corrective value COR. The program may be preferably carried out in the control device 6 and is assigned to the block B5. The program begins in a step S1, which is for example carried out on starting the internal combustion engine.

In a step S2 a test is carried out in order to check whether or not the predefined mode of operation BZ of the internal combustion engine is present. The predefined mode of operation BZ preferably may be a stationary mode of operation. In the stationary mode of operation, the predetermined fuel pressure FUP_SP is for example stationary and the detected fuel pressure FUP_AV is approximately the same as the predetermined fuel pressure FUP_SP. In addition, the quantity of fuel FUEL_MASS_REQ to be conveyed may be preferably stationary. A temperature of the internal combustion engine may be preferentially stationary, in particular a coolant temperature, an intake air temperature or an ambient temperature in each case are for example in a predetermined temperature range. In addition, the quantity of fuel MFF to be injected, and for this reason also the quantity of fuel FUEL_MASS_REQ to be conveyed, in the predefined mode of operation BZ may be preferably less than that of a predetermined threshold value, which is called a predetermined flow rate threshold value in this case. The predetermined flow rate threshold value may be preferably selected in such a way that said value is about as large as that of a leakage flow rate through the volume flow control valve 56 or is not substantially larger than the leakage flow rate. The exact dimensioning of the predetermined flow rate threshold value is in accordance with the precision requirements, which are made on determining the error value Q_ERR of the fuel flow rate or on determining the corrective value COR. In addition, no error should be diagnosed for the fuel delivering device in the predefined mode of operation BZ.

Only if in the step S2, the predefined mode of operation BZ is assumed, the program is continued in a step S3. In the step S3 a test is carried out in order to check whether or not a absolute value of the integral portion I_CTRL exceeds a predetermined threshold value LIM. If this condition is fulfilled, then in a step S4, the error value Q_ERR of the fuel flow rate is determined as a product of the integral portion I_CTRL and a predetermined factor F. The corrective value COR is determined as a product of the error value Q_ERR of the fuel flow rate and a predetermined step width factor STEP. The predetermined step width factor STEP may be preferably greater than zero and is, at maximum, equal to 1. The predetermined step width factor STEP may be preferably less than 0.1, for example from about 0.01 to 0.05.

In a step S5, the correction of the error value Q_ERR of the fuel flow rate is carried out by means of the determined corrective value COR, for example by correction of the predefined characteristic curve 7. The predefined characteristic curve 7 is then available in a corrected manner for regulating the fuel pressure, for example in the block B3.

After a predetermined waiting time T_W, the program is then continued in a step S3. The predetermined waiting time is for example about 100 milliseconds, but it can also be shorter or longer. The steps S3 to S5 may be preferably carried out until such time as the condition is not fulfilled in the step S3, i.e. the sum of the integral portion I_CTRL is less than or equal to the predetermined threshold value LIM. If the condition is not fulfilled in the step S3, then the program ends in a step S6. As an alternative, the program can also be started again in a step S1, after an additional waiting time has elapsed, if required.

The error value Q_ERR, can be corrected in one single iteration step, if the predetermined step width factor STEP is about equal to 1. However, the error value Q_ERR of the fuel flow rate may be preferably corrected in a number of iteration steps by presetting the step width factor STEP to less than one. This permits a gradual correcting of the predefined characteristic curve 7 to the actual characteristic curve of the specific volume flow control valve 56. A plurality of the necessary iteration steps depend on the selection of the predetermined step width factor STEP. In this way for example, some ten or also more than one hundred iteration steps can be necessary until the absolute value of the integral portion I_CTRL is less than or equal to the predetermined threshold value LIM and the program ends in a step S6.

The length of time, which is necessary for gradual correcting, depends on the waiting time T_W and the number of necessary iteration steps. If the resulting length of time is so long that the predefined mode of operation BZ can already be abandoned before ending the program, then it can be advantageous to carry out the step S2 after the step S5, before the condition in the step S3 is tested. Thus it is ensured that the predefined mode of operation BZ is present during the implementation of the steps S3 to S5.

The condition in the step S3 can as an alternative, or in addition, for example comprise a restriction in time for correcting the error value Q_ERR of the fuel flow rate. The program for example ends in the step S6 if the gradual adaptation is not yet final after for example ten seconds. In addition, the program can also end after a predetermined number of iteration steps have been carried out, for example after 200 iteration steps.

The adaptation of the predefined characteristic curve 7 can be implemented whenever the internal combustion engine is in the predefined mode of operation BZ and the absolute value of the integral portion is larger than the predetermined threshold value LIM. However, it can be sufficient to implement the program more rarely and at larger time intervals, since the leakage flow rate of the volume flow control valve 56 in the internal combustion engine in the predefined mode of operation BZ is only subject to small fluctuations.

The invention claimed is:

1. A method for controlling a fuel delivering device of an internal combustion engine, wherein the fuel delivering device has a high-pressure pump, which conveys fuel into a fuel reservoir, one or more injection valves supplied with fuel by the fuel reservoir, a fuel pressure sensor operable to detect a fuel pressure in the fuel reservoir, a volume flow control valve that is assigned to the high-pressure pump, the method comprising the steps of:

determining a control difference from a difference between a predefined fuel pressure and the detected fuel pressure, feeding the control difference to a controller that comprises a proportional component that outputs a fuel mass control value and an integral component that outputs an integrated value, comparing an absolute value of the integrated value to a, predetermined threshold value during the predefined mode of operation of the internal combustion engine, if the absolute value of the integrated value exceeds the predetermined threshold value during the predefined mode of operation of the internal combustion engine, determining a corrective value for an error value of a fuel flow rate based on the integrated value multiplied by a predetermined factor and a predetermined step width factor or the integrated value multiplied with a predetermined factor that includes the step width factor, determining the total quantity of fuel to be conveyed into the fuel reservoir based on (a) a preliminary quantity of fuel to be injected into the fuel reservoir (b) the fuel mass control value, and (c) a predefined quantity of fuel to be injected by the one or more injection valves, and generating an actuating signal for the volume flow control valve based on (a) the determined total quantity of fuel to be conveyed into the fuel reservoir and (b) the determined corrective value.

2. The method according to claim 1, wherein the corrective value is determined as the integrated value multiplied by a predetermined factor.

3. The method according to claim 2, wherein the predetermined factor comprises a predetermined step width factor or in which the corrective value is determined as the integrated value multiplied by the predetermined factor and multiplied by the predetermined step width factor.

4. The method according to claim 1, wherein the predefined mode of operation is a stationary mode of operation.

5. A device for controlling a fuel delivering device of an internal combustion engine, with the fuel delivering device comprising a high-pressure pump, which conveys fuel into a fuel reservoir, one or more injection valves supplied with fuel by the fuel reservoir, a fuel pressure sensor operable to detect a fuel pressure in the fuel reservoir, a volume flow control valve, that is assigned to the high-pressure pump, wherein the device is operable to determine a control difference from a difference between a predefined fuel pressure the detected fuel pressure, to feed the control difference to a controller that comprises a proportional component that outputs a fuel mass control value and an integral component that outputs an integrated value, to compare an absolute value of the integrated value to a predetermined threshold value during the predefined mode of operation of the internal combustion engine, to determine a corrective value for an error value of a fuel flow rate based on the integrated value multiplied by a predetermined factor and a predetermined step width factor or the integrated value multiplied with a predetermined factor that includes the step width factor if the absolute value of the integrated value exceeds the predetermined threshold value during the predefined mode of operation of the internal combustion engine, to determine the total quantity of fuel to be conveyed into the fuel reservoir based on (a) a preliminary quantity of fuel to be injected into the fuel reservoir (b) the fuel mass control value, and (c) a predefined quantity of fuel to be injected by the one or more injection valves, and to generate an actuating signal for the volume flow control valve based on (a) the determined total quantity of fuel to be conveyed into the fuel reservoir and (b) the determined corrective value.

6. The device according to claim 5, wherein the corrective value is determined as the integrated value multiplied by a predetermined factor.

7. The device according to claim 6, wherein the predetermined factor comprises a predetermined step width factor or in which the corrective value is determined as the integrated value multiplied by the predetermined factor and multiplied by the predetermined step width factor.

8. The device according to claim 5, wherein the predefined mode of operation is a stationary mode of operation.

9. A method for controlling a fuel delivering device of an internal combustion engine including a fuel reservoir and one or more injection valves coupled to the fuel reservoir, comprising the steps of:

determining a control difference from a difference between a predefined fuel pressure and the detected fuel pressure, feeding the control difference to a controller that comprises a proportional component that outputs a fuel mass control value and an integral component that outputs an integrated value, comparing an absolute value of the integrated value to a predetermined threshold value during the predefined mode of operation of the internal combustion engine, if the absolute value of the integrated value exceeds the predetermined threshold value during the predefined mode of operation of the internal combustion engine, determining a corrective value for an error value of a fuel flow rate based on the integrated value multiplied by a predetermined factor and a predetermined step width factor or the integrated value multiplied with a predetermined factor that includes the step width factor, determining the total quantity of fuel to be conveyed into the fuel reservoir based on (a) a preliminary quantity of fuel to be injected into the fuel reservoir, (b) the fuel mass control value, and (c) a predefined quantity of fuel to be injected by the one or more injection valves, and generating an actuating signal for the volume flow control valve based on (a) the determined total quantity of fuel to be conveyed into the fuel reservoir and (b) the determined corrective value.

10. The method according to claim 9, wherein the corrective value is determined as the integrated value multiplied by a predetermined factor.

11. The method according to claim 10, wherein the predetermined factor comprises a predetermined step width factor or in which the corrective value is determined as the integrated value multiplied by the predetermined factor and multiplied by the predetermined step width factor.

12. The method according to claim 9, wherein the predefined mode of operation is a stationary mode of operation.

* * * * *

UNITED STATES PATENT AND TRADEMARK OFFICE

CERTIFICATE OF CORRECTION

PATENT NO. : 8,347,863 B2
APPLICATION NO. : 11/913125
DATED : January 8, 2013
INVENTOR(S) : Martin Cwielong et al.

It is certified that error appears in the above-identified patent and that said Letters Patent is hereby corrected as shown below:

On the title page item 54, and col. 1, line 1, Title, "Method for Controlling a Fuel Delivery Device on an Internal Combustion Engine" should read -- METHOD FOR CONTROLLING A FUEL DELIVERING DEVICE OF AN INTERNAL COMBUSTION ENGINE --.

Signed and Sealed this
Twenty-sixth Day of March, 2013

Teresa Stanek Rea
*Acting Director of the United States Patent and Trademark Office*